US006705693B2

(12) United States Patent
Lim et al.

(10) Patent No.: US 6,705,693 B2
(45) Date of Patent: Mar. 16, 2004

(54) ADJUSTABLE PEN-TO-PAPER SPACING MECHANISM

(75) Inventors: Kong Hock Lim, Singapore (SG); Hock Lim Lee, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/136,006

(22) Filed: Apr. 30, 2002

(65) Prior Publication Data

US 2003/0081022 A1 May 1, 2003

(30) Foreign Application Priority Data

Oct. 26, 2001 (SG) ..... 200106651-3

(51) Int. Cl.[7] ..... B41J 25/308
(52) U.S. Cl. ..... 347/8
(58) Field of Search ..... 347/20, 8, 9, 19, 347/14, 104, 10; 346/139 R; 400/56, 645, 708, 709, 74; 395/103, 105, 37, 102, 104, 5, 2, 56, 57, 58, 59, 60

(56) References Cited

U.S. PATENT DOCUMENTS 5,187,497 A * 2/1993 Hirano et al. ..... 347/8
5,414,453 A * 5/1995 Rhoads et al. ..... 347/8

* cited by examiner

*Primary Examiner*—Raquel Yvette Gordon
*Assistant Examiner*—Charles Stewart, Jr.

(57) ABSTRACT

A printer with adjustable PPS is provided. The printer includes a printer frame structure, a carriage movable in the printer frame structure for movement across a print zone during printing operations, and at least one cartridge mounted on the carriage for printing on a medium in the print zone. The printer further has means for driving the cartridge relative to the printer between a first position in which the printer prints at a first PPS measured from a bottom surface of the medium, and a second position in which the printer prints at a second PPS.

3 Claims, 4 Drawing Sheets

ADJUSTABLE PEN-TO-PAPER SPACING MECHANISM

BACKGROUND

This invention relates generally to inkjet printers, and in particular to techniques for adjusting a pen-to-paper spacing.

As shown in FIG. 1, in this application a pen-to-paper spacing (PPS) is defined as the distance between a cartridge 103 of an inkjet printer and a bottom surface 118 of a media sheet 117 which is in a print zone 116 and which is supported by a platen 120 for printing. The PPS and the thickness of the media sheet 117 determine the distance between the cartridge 103 and an upper surface 119 of the media sheet 117. Maintaining a suitable distance between the cartridge 103 and the upper surface 119 is important to achieve the best image quality possible.

Normally, when the printer is manufactured, the PPS is set and fixed at a nominal value based upon a default medium having a default thickness. Nevertheless, the distance between the cartridge 103 and the upper surface 119 of the media sheet 117 may vary as media of various thicknesses are used.

Especially, when a medium thicker than the default medium is used, and if the PPS remains unchanged, the distance between the cartridge 103 and the upper surface 119 of the media sheet 117 can be relatively close. Thus, there is the possibility of the cartridge 103 contacting the upper surface 118 of the media sheet 117 during printing. This phenomenon may cause the media sheet 117 to be smeared.

However, when a medium thinner than the default medium is used and if the PPS remains unchanged, the distance between the cartridge 103 and the upper surface 119 of the media sheet 117 can be relatively far. This may affect the accurate placement of ink dots when ink drops are ejected onto the medium and consequently the printing quality as well.

Therefore, there is a need for adjusting the PPS distance in an inkjet printer.

SUMMARY

According to a first embodiment of the invention, an inkjet printer includes a printer frame structure, a carriage movable in the printer frame structure for movement across a print zone during printing operations, and at least one cartridge mounted on the carriage for printing on a medium in the print zone. The printer further includes means for driving the cartridge between a first position in which the printer prints at a first PPS measured from a bottom surface of the medium, and a second position in which the printer prints at a second PPS.

According to a second embodiment of the invention, an inkjet printer for printing on a medium in a print zone includes a printer frame structure, a first path and a second path defined in the printer frame structure, and a carriage movable in the printer frame structure for movement across the print zone during printing operations. The carriage has a first slider for moving along one of the first and the second paths. Further more, the printer prints at a first PPS distanced from a bottom surface of the medium as the first slider moves along the first path, while prints at a second PPS distanced from said bottom surface as the first slider moves along the second path.

In an aspect of the invention, the printer includes at least one cartridge mounted on the carriage. The printer also includes means located below the cartridge for driving the cartridge relative to the printer frame structure in a direction vertical to the medium from a first position in which the printer prints at the first PPS to a second position in which the printer prints at the second PPS.

According to a second embodiment of the invention, an inkjet printer for printing on a medium in a print zone includes a printer frame structure, a carriage movable in the printer frame structure for movement across the print zone during printing operations. The carriage includes a first slider and a second slider disposed at the front and back of the carriage respectively. The printer also includes a first rail mounted on the printer frame structure and disposed at the front of the carriage for the first slider to move along with. The first rail determines a first pen-to-paper spacing distanced from a bottom surface of the medium at which spacing the printer prints as the first slider moves along the first rail. The printer further has a second rail mounted on the printer frame structure and disposed at the back of the carriage for the second slider to move along with. The second rail determines a second pen-to-paper spacing distanced from said bottom surface at which spacing the printer prints as the second slider moves along the second rail Other aspects and advantages of the invention will become apparent from the following detailed description, taken in conjunction with the accompanying drawings, illustrating by way of example the principles of the invention.

DETAILED DESCRIPTION

Figure 1:
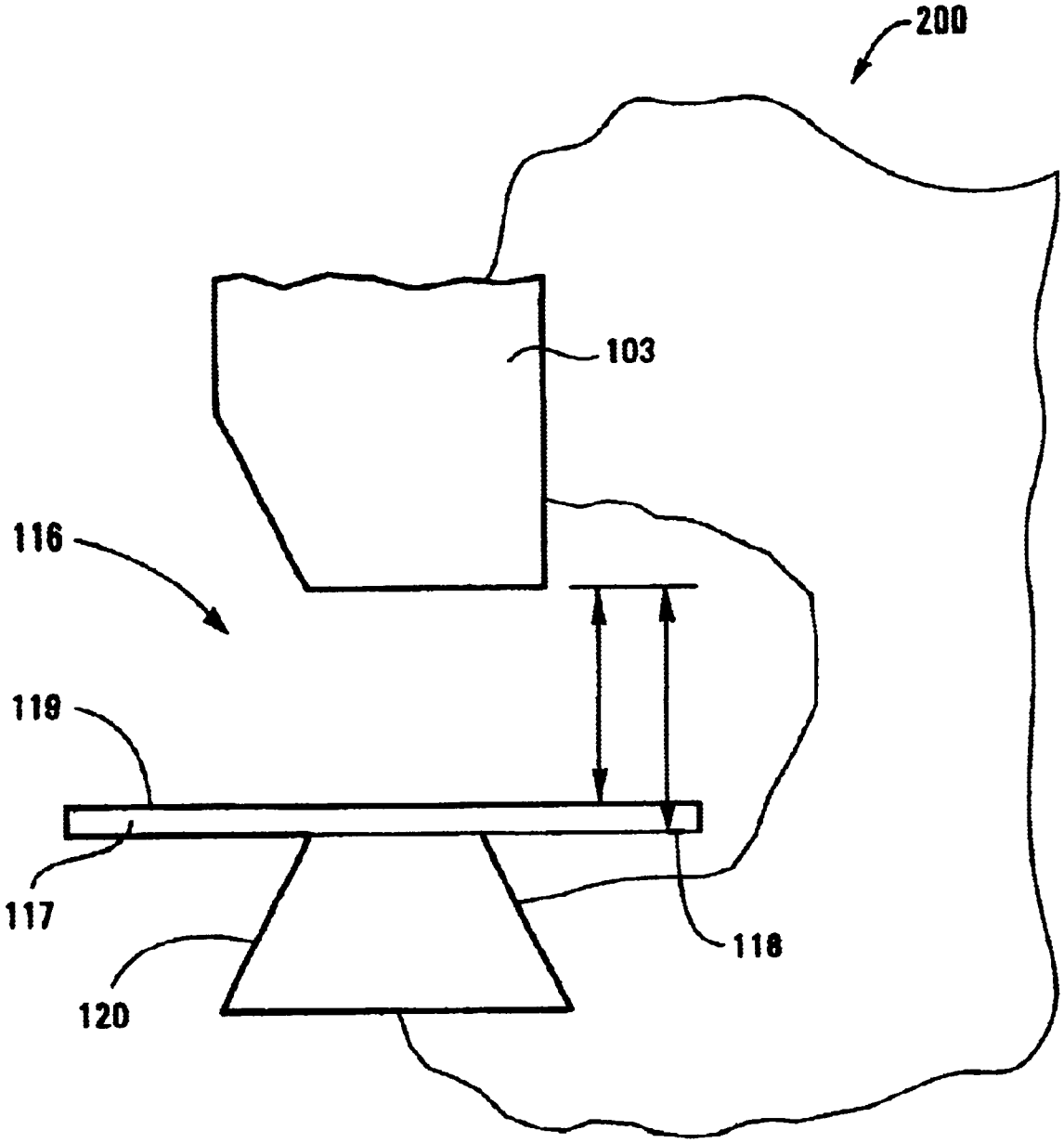
FIG. 1 illustrates a cartridge printing on a medium having an upper surface and a bottom surface to define PPS in a printer.
Figure 2:
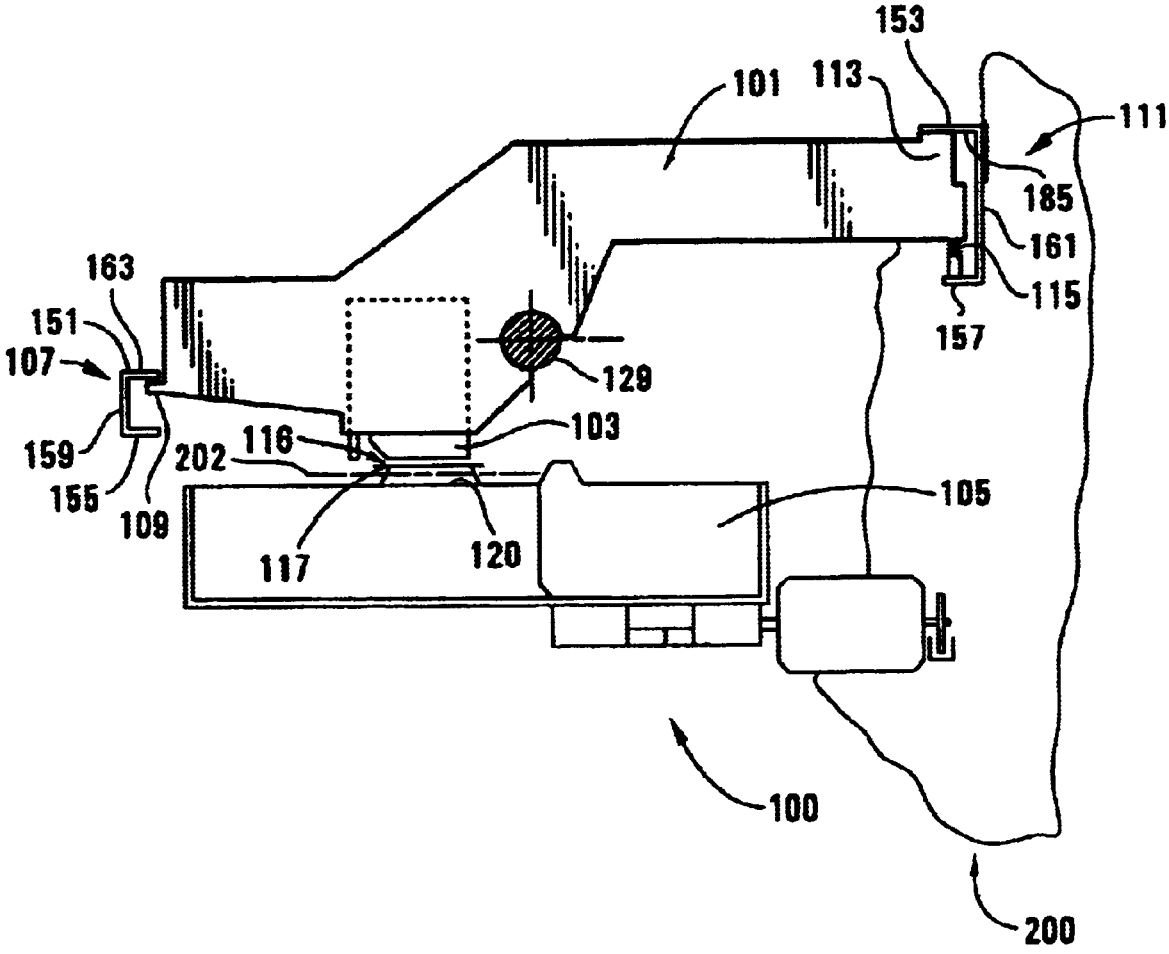
FIG. 2 illustrates an embodiment of the invention in which a printer prints at a normal PPS.

FIG. 2 shows a part of an inkjet printer 100 according to an exemplary embodiment of the invention. The printer 100 has a printer frame structure 200 (partially shown), a platen 120 in a print zone 116 for supporting a media sheet 117 during printing, a carriage 101 sliding on a longitudinal guide rod 129, a first guide preferably a rail 107 and a second guide preferably also a rail 111. The guide rod 129, the platen 120, the first rail 107 and the second rail 111 are all mounted on the printer frame structure 200.

In the embodiment shown in FIG. 2, a cartridge 103 is mounted on the carriage 101. The carriage 101 slides on the longitudinal guide rod 129 and moves along a cartridge scan axis 206 (see FIG. 4) across the print zone 116 during printing operations such that the cartridge 103 can imprint images on the media sheet 117 advanced to the print zone 116.

Figure 4:
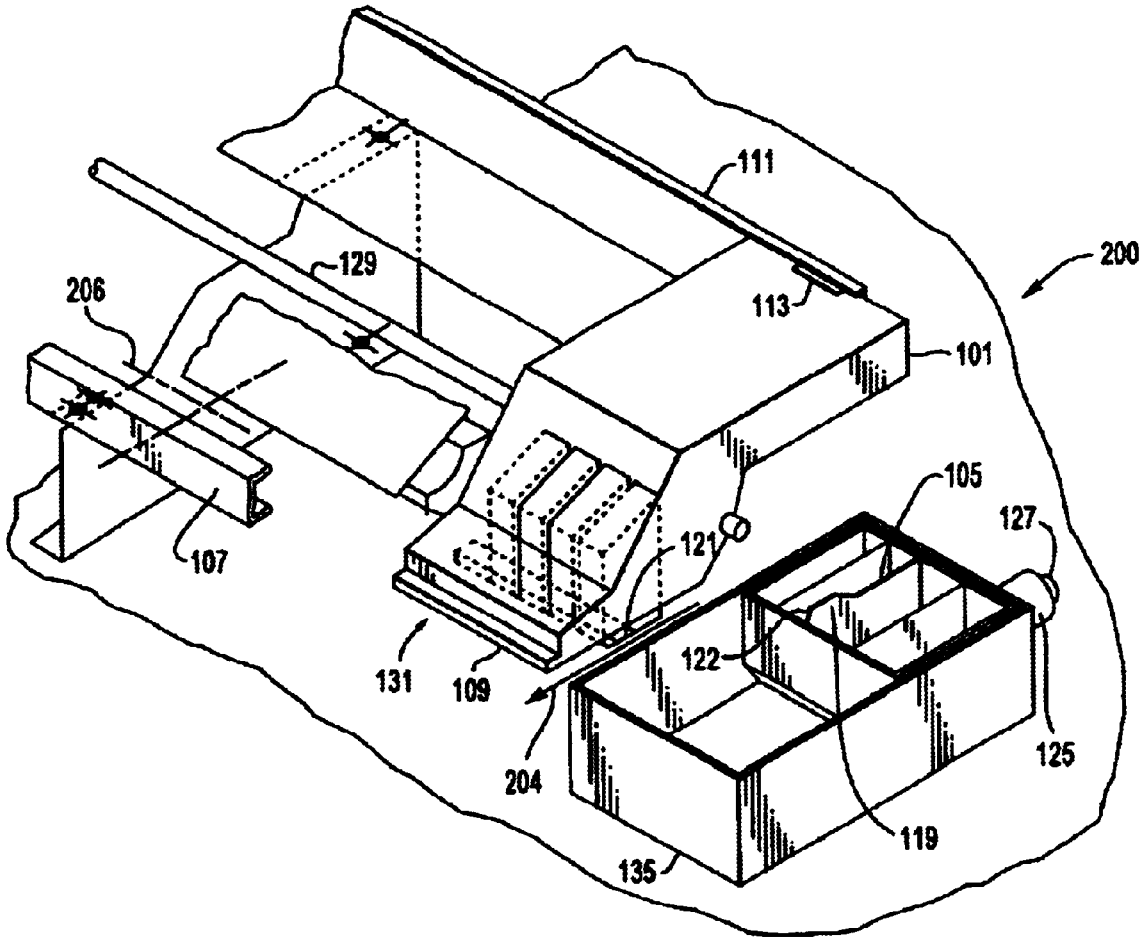
FIG. 4 is a close-up view of the mechanism for adjusting the PPS according to an embodiment of the invention.

In FIGS. 2 and 4, a service station carrier 105 carrying a service station 135 for servicing the cartridge 103 is provided. The service station carrier 105 is movable along a media movement axis 202 (shown in FIG. 2) perpendicular to the cartridge scan axis 206. When a servicing is desired, the service station carrier 105 moves to a servicing space and the carriage 101 moves to a servicing position above the servicing space such that the cartridge 103 can be serviced.

Figure 3:
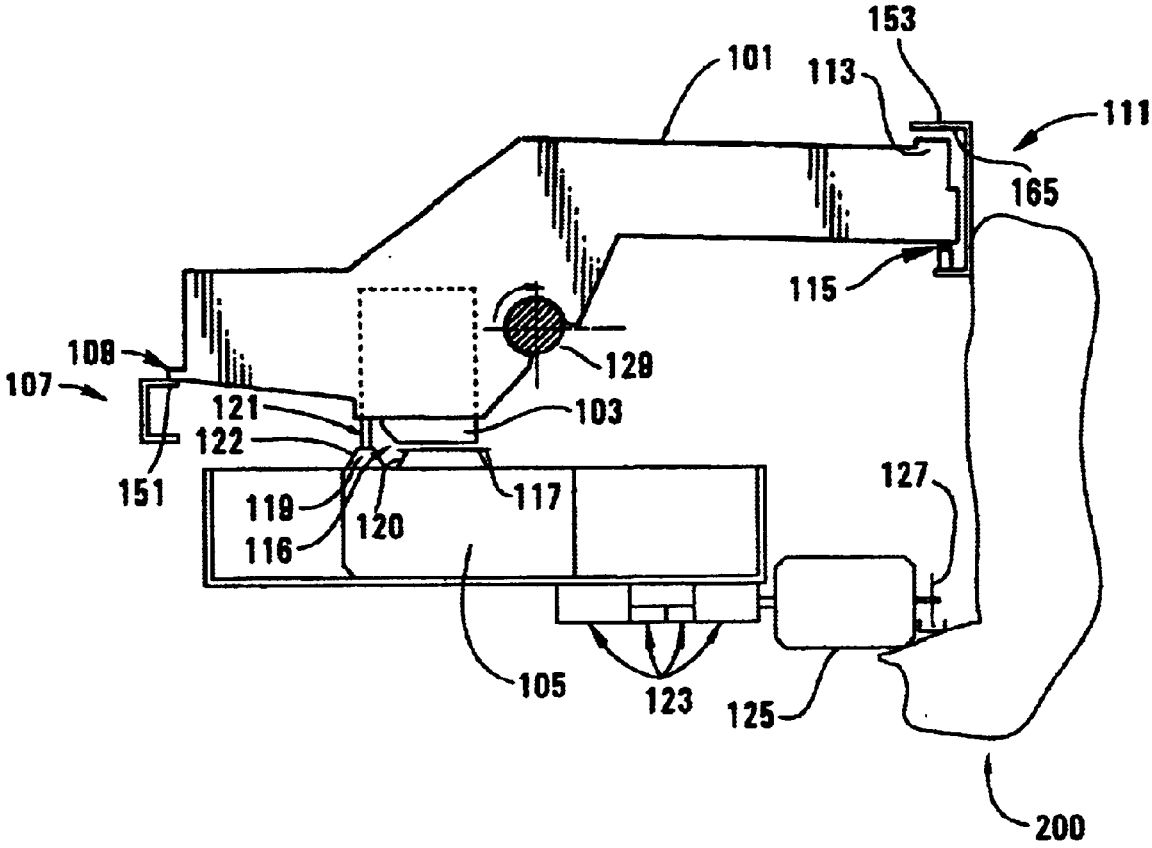
FIG. 3 shows the printer of FIG. 2 when it prints at a larger PPS.

In FIGS. 3 and 4, a service station motor 125 mounted on the printer frame structure provides the driving force for the service station carrier 105 through a gear train 123. Furthermore, movement of the service station carrier 105 is commanded by firmware in the printer 100 and controlled by an encoder disc 127 mounted on a shaft of the service station motor 125. Such a control mechanism is well known in the art.

As shown in FIGS. 2 and 4, the first rail 107 and the second rail 111 extend horizontally and substantially parallel to the guide rod 129. In addition, the two rails 107, 111 are located at different sides, i.e., the front and the back of the guide rod respectively. In this embodiment, both the first and second rails have an upper portion 151, 153, a lower portion 155, 157, and a web 159, 161 connecting the upper and lower portions, all extending horizontally. In addition, as shown in FIG. 4, the first rail 107 is positioned such that an opening 131 is created along a first rail 107 and is opposite to the servicing position. The opening 131 allows the first slider 109 to move upward from a position under the upper portion 151 of the first rail 107 to a position above the upper portion 151 when the carriage 101 is in the servicing position.

In FIG. 2, the first slider 109 and a second slider 113 are provided on the carriage for sliding along the first rail 107 and the second rail 111 respectively. While the printer 100 prints at a normal PPS as shown in FIG. 2, the first slider 109 slides along a first path defined by a space under the upper portion 151 of the first rail 107. The second slider 113 has a spring 115 such that the second slider 113 is urged against and moves along the lower portion 157 of the second rail 111. As the printer 100 prints at the normal PPS, the second slider 113 is in contact with an inner surface 165 of the upper portion 153 of the second rail 111 and moves along the inner surface 165. The carriage 101 is thus prevented from further rotating in an anti-clockwise direction about the guide rod 129, and the normal PPS can be maintained. In this application, a clockwise direction is defined as such a direction that when the carriage 101 rotates about the guide rod 129 in the clockwise direction, the cartridge 103 is driven upward.

In the embodiment of the invention, the printer 100 can adjust the PPS upon receiving a command from a printer driver installed in a computer (not shown) which is connected to the printer 100. In this embodiment, for example, a user specifies the type of media sheet to be printed by clicking on a printer driver printing dialogue box on the computer (not shown). The printer driver then identifies whether the media type selected is a normal or thick print media. If a thick media is selected, the printer driver instructs the printer 100 in the command to increase the PPS accordingly.

As shown in FIG. 3, when a larger PPS is desired, the carriage 101 moves to the servicing position on receiving the command from the printer driver to increase the PPS. The servicing position is located at an end along the cartridge scan axis.

Next, driven by the service station motor 125, the service station carrier 105 moves forward in a media movement direction 204 (see FIG. 4) toward the servicing space. An inclined ramp 122 of an actuator 119 mounted on the service station carrier 105 comes into contact with an extension rib 121 mounted on the carriage 101. In this application, the media movement direction is defined as the direction in which the media sheet 117 in the print zone 116 is advanced during printing. From FIG. 3 it is noted that the actuator 119 is located behind the service station 135 in the media movement direction, while the extension rib 121 is located in front of the cartridge 103 in the media movement direction 204. Thus, when a normal servicing is requested, the actuator 119 would not be in contact with the extension rib 121 and the PPS would not be changed. For the actuator 119 and the extension rib 121 to be in contact so as to push the cartridge 103 upward, the service station carrier 105 needs to move forward further in the media movement direction. Such a movement is controlled by the encoder disc 127.

Controlled by the encoder disc 127, the service station carrier 105 keeps moving forward in the media movement direction 204. The inclined ramp 122 of the actuator 119 pushes the extension rib 121 upward, i.e., in a direction vertical to the media sheet 117, and the carriage 101 consequently rotates about the guide rod 129 in the clockwise direction. In addition, along with the carriage 101, the cartridge 103 is driven relative to the printer in a direction vertical to the medium from a first position in which the printer prints at the normal PPS to a second position in which the printer prints at the larger PPS.

Consequently, the first slider 109 moves upward through the opening 131 to a position above the upper portion 151 of the first rail 107. On the other hand, the second slider 113 leaves the inner surface 165 of the upper portion 153 of the second rail 111 and the spring 115 is compressed. The second rail 111 prevents the carriage from rotating about the guide rod 129 to exceed a predetermined degree.

The carriage 101 then moves out from the servicing position. Now the first slider 109 rests atop the upper portion 151 of the first rail 107 and slides along a second path defined by an upper surface 163 of the upper portion 151 of the first rail 107 during the following printing session. The first rail 107 prevents the carriage 101 from rotating in the anti-clockwise direction, and the desired larger PPS is maintained.

When the printing job is completed, the carriage 101 moves to the servicing position. When the carriage 101 arrives at the servicing position, the first slider 109 leaves the first rail 107 and reaches the opening 131. In addition, the service station carrier 105 retreats backward in the media movement direction 204. Without the first rail 107 supporting the first slider 109, the carriage 101 tends to rotate in the anti-clockwise direction by its own weight. As the service station carrier 105 retreats, the extension rib 121 and consequently the carriage 105 slides down the inclined ramp 122. The cartridge 103 returns to its first position, i.e., the position in which the printer prints at the normal PPS, when the extension rib 121 is no longer in contact with the actuator 119. The upper portion 153 of the second rail 111 comes into contact with the second slider 113 and prevents the carriage 101 from further anti-clockwise rotation about the guide rod 129.

Alternatives can be made to the preceding embodiment. For example, instead of the actuator 119 on the service station carrier 105 and the extension rib on the carriage 101, electromagnetic mechanism can be used to drive the carriage 101 to rotate in the clockwise direction when the larger PPS is desired. Besides, if the cartridge 103 is movable in a vertical direction relatively to the carriage 101, the PPS can be adjusted by driving the cartridge directly instead of through a rotating carriage 101.

In addition, the distance between the upper portion 151 and the lower portion 155 of the first rail 107 can be configured such that as the printer prints at the normal PPS, the first slider 109 rests atop and moves along the lower portion 155. The upper portion 153 of the second rail 111 can be removed by horizontally extending the lower portion 155 to the opening 131 for supporting the first slider 109 as the cartridge returns to its normal PPS.

Furthermore, a mid-portion located between the upper portion 151 and the lower portion 153 can be added to the first rail 107. By controlling the movement of the service station carrier 105, the first slider 109 can be positioned atop the mid portion rather than on the upper portion 151 of the first rail 107. Thereby, a printer adjustable between three PPS distances can be provided.

What is claimed is:

1. An inkjet printer, comprising:

a printer frame structure;

a carriage movable in the printer frame structure for transporting a cartridge to a servicing position, where servicing of the cartridge can be performed; and a service station carrier movable in the printer frame structure to a servicing place below the cartridge which has moved to said servicing position, the service station carrier including an actuator mounted thereon for pushing the carriage, which has moved to said servicing position, upwards so as to increase a pen-to-paper spacing measured from a bottom surface of a medium in a print zone of the printer.

2. The printer of claim 1, further comprising:

a rail extending horizontally, the rail having an opening at a longitudinal end thereof approximately above the servicing position;

wherein the carriage includes a slider, wherein the actuator pushes the carriage upwards such that the slider moves upwards through said opening to a position above said rail, and wherein the increased pen-to-paper spacing is maintained through said slider sliding atop said rail during subsequent operations.

3. The printer of claim 1, wherein the actuator is positioned such that the actuator does not interact with the carriage during a servicing process.

* * * * *